US011821250B2

(12) United States Patent
Schneiderbanger et al.

(10) Patent No.: US 11,821,250 B2
(45) Date of Patent: Nov. 21, 2023

(54) SPINDLE DRIVE FOR A CLOSURE ELEMENT OF A MOTOR VEHICLE

(71) Applicant: Brose Fahrzeugteile SE & Co. Kommanditgesellschaft, Bamberg, Bamberg (DE)

(72) Inventors: Michael Schneiderbanger, Rattelsdorf (DE); Stefan Wild, Shanghai (CN); Harald Krüger, Bamberg (DE)

(73) Assignee: BROSE FAHRZEUGTEILE SE & CO. KOMMANDITGESELLSCHAFT, BAMBERG, Bamberg (DE)

( * ) Notice: Subject to any disclaimer, the term of this patent is extended or adjusted under 35 U.S.C. 154(b) by 457 days.

(21) Appl. No.: 17/271,710

(22) PCT Filed: Aug. 23, 2019

(86) PCT No.: PCT/EP2019/072540
§ 371 (c)(1),
(2) Date: Feb. 26, 2021

(87) PCT Pub. No.: WO2020/043603
PCT Pub. Date: Mar. 5, 2020

(65) Prior Publication Data

US 2021/0317695 A1 Oct. 14, 2021

(30) Foreign Application Priority Data

Aug. 29, 2018 (DE) ..... 10 2018 121 033.7

(51) Int. Cl.
*E05F 1/10* (2006.01)
*E05F 15/622* (2015.01)

(52) U.S. Cl.
CPC ..... *E05F 15/622* (2015.01); *E05F 1/105* (2013.01); *E05Y 2201/21* (2013.01);
(Continued)

(58) Field of Classification Search
CPC ..... E05F 15/622; E05F 1/105; E05F 15/41; E05Y 2201/21; E05Y 2201/474;
(Continued)

(56) References Cited

U.S. PATENT DOCUMENTS

2012/0024092 A1* 2/2012 Schonherr ..... E05F 15/622 74/89.23
2015/0069869 A1 3/2015 Loeffler et al.

FOREIGN PATENT DOCUMENTS

DE 102008005229 A1 * 7/2009 ..... E05F 15/622
DE 102008031228 A1 * 1/2010 ..... E05F 15/622
(Continued)

*Primary Examiner* — T. Scott Fix
(74) *Attorney, Agent, or Firm* — Dickinson Wright PLLC

(57) ABSTRACT

The invention concerns a spindle drive for a closing element (3) of a motor vehicle (4), wherein in a drive train (14) of the spindle drive (1), a drive unit (5) is provided together with a spindle-nut gear (11) located drivingly downstream of the drive unit (5), with geometric spindle axis (A) running in the axial direction (X), in order to generate linear drive movements of a spindle-side drive connection (12*a*) relative to a nut-side drive connection (12*b*) between a retracted position and an extended position of the spindle drive (1), wherein in the drive train (14) a nominal break point (17) is provided which separates the drive train (14) at a predetermined axial limit load acting on the spindle drive (1) via the drive connections (12*a*, 12*b*), in particular a tensile load in the direction of the extension position. It is proposed that the drive train (14) is separated via the nominal break point (17) between the drive unit (5) and the spindle-nut gear (11).

19 Claims, 5 Drawing Sheets

(52) U.S. Cl.
CPC ... *E05Y 2201/474* (2013.01); *E05Y 2800/406* (2013.01); *E05Y 2900/546* (2013.01)

(58) Field of Classification Search
CPC ..... E05Y 2800/406; E05Y 2900/546; F16H 25/2021; F16H 25/2025; F16H 2025/2071
USPC ..... 74/89.23
See application file for complete search history.

(56) References Cited

FOREIGN PATENT DOCUMENTS

| | | | | |
|---|---|---|---|---|
| DE | 102009033277 A1 * | 1/2011 | ..... | E05F 15/622 |
| DE | 202010009334 U1 | 9/2011 | | |
| DE | 102014100125 A1 * | 7/2015 | ..... | E05F 15/622 |
| DE | 102014117008 A1 * | 5/2016 | | |
| DE | 102016116876 A1 | 3/2018 | | |

* cited by examiner

SPINDLE DRIVE FOR A CLOSURE ELEMENT OF A MOTOR VEHICLE

CROSS-REFERENCE TO RELATED APPLICATIONS

This application is the U.S. National Phase of PCT Application No. PCT/EP2019/072540 filed on Aug. 23, 2019, which claims priority to German Patent Application No. DE 10 2018 121 033.7, filed on Aug. 29, 2018, the disclosures of which are hereby incorporated in their entirety by reference herein.

TECHNICAL FIELD

The present invention concerns a spindle drive for a closing element of a motor vehicle, and a closing element assembly of a motor vehicle with a closing element.

BACKGROUND

The spindle drive concerned is used in the context of motorized movement of any closing elements of a motor vehicle. Such closing elements may for example be tailgates, boot (trunk) lids, hoods, luggage compartment floors, but also doors, in particular sliding doors, of a motor vehicle. To this extent, the term "closing element" should be understood broadly in the present case.

SUMMARY

The invention is based on the problem of designing and refining the known spindle drive so as to increase safety with respect to the retaining function.

A nominal break point is provided in the drive train which is spaced from the drive connections inside the spindle drive in order to lead to an interruption of the force flow if the axial load limit is reached. The drive connections thus remain intact and the connection to the motor vehicle is retained. At the same time, according to the proposal, the nominal break point is arranged at a location which, when the axial load limit is reached, causes no or in any case no significant damage to the drive components achieving the linear drive movements, i.e., the components of the electric drive unit on one side and the components of the downstream spindle-nut gear on the other. Despite separation of the drive train in the load limit case, therefore, the drive unit on one side and the spindle-nut gear on the other remain at least substantially intact. In addition, in the case of a telescopic housing, the nominal break point is arranged such that in the load limit case, and namely also in the spindle drive present in the extended position, despite separation of the drive train, the drive tube is still axially guided relative to the output tube, and thus the housing still retains the drive components in the inside of the spindle drive via the telescopic connection. The spindle drive does not therefore—at least not directly on occurrence of the load limit case—break into two separate components, but still forms one unit which continues to provide the retaining function and manual operation of the closing element, for example a tailgate. The robustness of a drive connection compared with one having a nominal break point is substantially increased, which is advantageous with respective active/passive systems.

In detail, it is proposed that the drive train is separated via the nominal break point between the drive unit and the spindle-nut gear. The nominal break point is thus arranged such that the force flow, in particular the torque transmission, between the drive unit and the spindle-nut gear is interrupted in the load limit case. The drive connections remain intact and the spindle drive is not torn away from the motor vehicle, in particular the closing element or the body, and thus still retains its function with restrictions.

The term "nominal break point" in the sense of the proposal quite generally means a targeted weak point within a component or a connection of two components. A separation occurring in the load limit case at this point, i.e., a division into two parts, is not necessarily provoked by a breakage of the material but may also be provoked by separation of a form-fit and/or force-fit and/or material-bonded connection. In particular, a nominal break point also means a crimping (stamping) of two components together, which is designed weaker with respect to an axial load, such as a tensile load, than all other components and connection points receiving this same load. To this extent, the term "nominal break point" should be understood broadly in the present case.

According to an embodiment, the spindle drive includes a housing with a drive tube and an output tube which cooperate with each other telescopically. Preferably, the drive tube or the output tube forms the inner tube which is guided in the respective other tubular housing part. The overlap of the two tubular housing parts in the axial direction in the load limit case ensures that the respective drive components are retained in the housing on separation of the drive train between the drive unit and spindle-nut gear. Thus, by separating the drive train in the load limit case, a first component unit and a second component unit are formed, which are still movable relative to each other in the axial direction within certain limits as long as there is an overlap between the tubular housing parts.

In another embodiment, the spindle drive has a spring arrangement which, in regular operation, preloads the spindle-side drive connection and nut-side drive connection, and hence also the spindle and the nut, away from each other to the extended position of the spindle drive. The spring arrangement may include a spring element, such as a compression spring, for example a coil compression spring, which is preloaded in the spindle drive. Preferably, on separation of the drive train in the load limit case, the spring element is part of the second component unit. In one embodiment, the spring bearings of the spring arrangement, on which the spring element bears under preload, and/or a spring guide tube are part of the second component unit. Also, on release of the first component unit from the second component unit in the load limit case, the spring element may thus be retained inside the second component unit and does not come free suddenly.

The nominal break point may formed by a radial connecting point between two components, of which the first component may be an annular or sleeve-like fixing element, such as a crimp ring, and of which the second component may be a tubular housing part, wherein the latter may be one of the tubes forming the housing (drive tube or output tube) and/or a drive cartridge for receiving the drive unit components.

The respective drive connection may include a socket or a ball for a ball-socket coupling of the spindle drive to the body or closing element. The socket or ball of the respective drive connection, such as a guide peg of the socket or ball for connection of the drive connection to the housing, is configured without a nominal break point.

In addition, the problem described above may be solved by a closing element assembly of a motor vehicle. This further teaching has independent significance. With the proposed closing element assembly, the same advantages are achieved as described above in connection with the proposed spindle drive. Reference may therefore be made to all statements relating to the proposed spindle drive.

BRIEF DESCRIPTION OF THE DRAWINGS

The invention is explained in more detail below with reference to a drawing showing merely exemplary embodiments.

DETAILED DESCRIPTION

Figure 1:
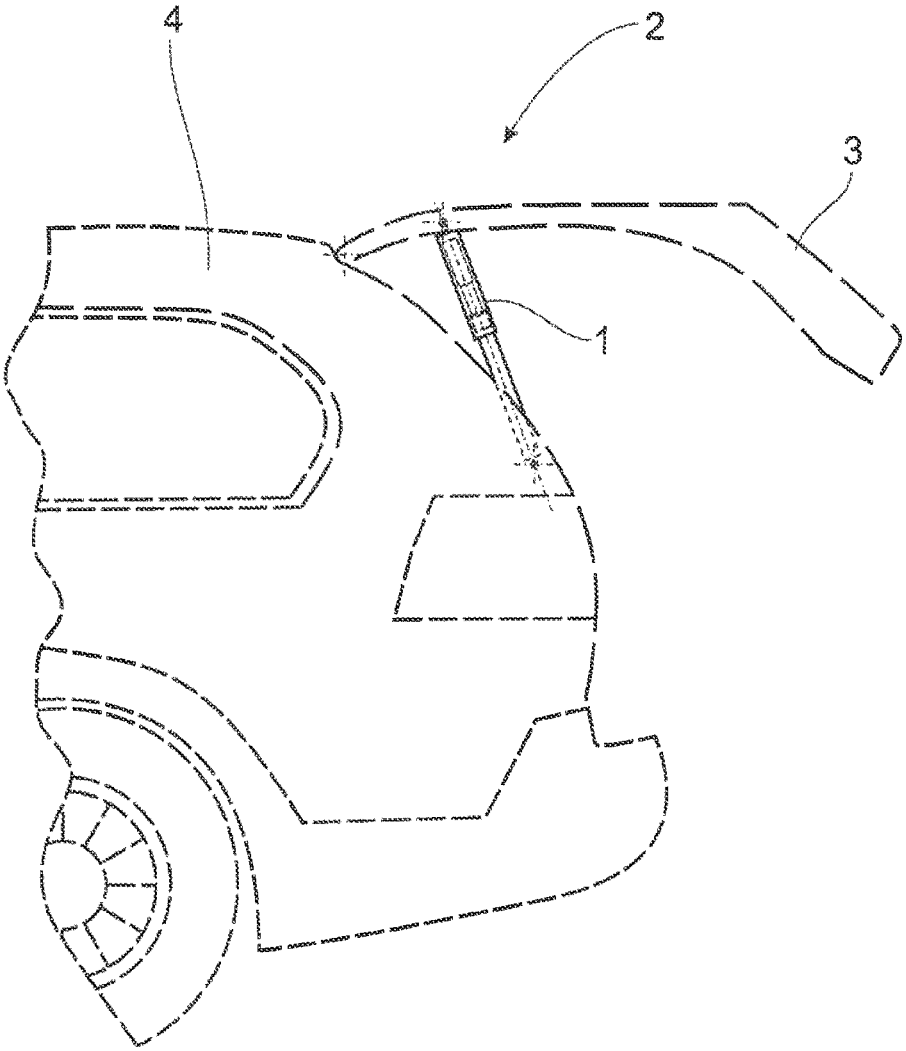
FIG. 1 illustrates a rear part of a motor vehicle with a proposed spindle drive for the tailgate assembly there.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A known spindle drive is DE 20 2010 009 334 U1. This spindle drive has an electric drive unit and a spindle-nut gear located drivingly downstream of the electric drive unit, with which linear drive movements of the spindle-side drive connection relative to a nut-side drive connection of the spindle drive are generated, in order to open and close the closing element. In the open position of the closing element, the spindle drive is accordingly in an extended position, whereas in a closed position of the closing element, the spindle drive is in a retracted position.

The spindle drive has an output tube coupled axially fixedly to the nut-side drive connection, and a drive tube coupled axially fixedly to the spindle-side drive connection and guided telescopically in said output tube. The nut-side drive connection, which is configured as a ball socket here, has a guide peg which is mounted axially fixedly and rotatably in a guide sleeve coupled axially fixedly to the output tube. The nut-side drive connection has a nominal break point in its guide peg, which breaks in targeted fashion under an axial load limit—here a tensile load—acting on the spindle drive via the drive connections, in order to protect the remainder of the spindle drive from damage. An axial load limit may be reached for example on a panic intervention by a user against the electric closing movement of the tailgate, or if the user moves the tailgate up beyond the mechanical stop.

It is particularly advantageous in the known spindle drive that, even after the spindle drive has torn away from the tailgate or body of the motor vehicle, the housing and the components of the spindle drive surrounded by the housing remain intact. There is, therefore, no danger that a compression spring of a spring arrangement of the spindle drive, which preloads the spindle-side drive connection and the nut-side drive connection against each other in the extended position, will suddenly be released and break free, which may lead to a risk of injury to the user. However, after the spindle drive has torn away, the retaining function no longer exists. Furthermore, the provision of a nominal break point in the region of a drive connection counters a high robustness of the drive connection, which is necessary in particular in active/passive systems since the active side, i.e., the spindle drive with the drive unit, must also receive the spring force of the passive side, i.e., a non-driven gas compression spring, which leads to an increased tensile load on the drive connections of the active side. A nominal break point on the active side may thus also reduce safety.

The proposed spindle drive 1 is assigned to a closing element assembly 2, in FIG. 1 for example a tailgate assembly, which in turn is equipped with a closing element 3 such as a tailgate. The closing element assembly 2 is assigned to a motor vehicle 4.

The closing element 3 may, as initially stated, also be another closing element of a motor vehicle 4, such as a boot lid or a sliding door. All statements apply accordingly for other closing elements.

FIG. 1 shows that to open and close the closing element 3, the spindle drive 1 of the closing element assembly 2 of a motor vehicle 4 has a drive unit 5. The drive unit 5, as shown in particular in FIGS. 2 to 5, includes a plurality of components 6, 7, 8 which are arranged successively in the axial direction X and are connected together in a torque-transmissively way. These drive unit components 6, 7, 8 are mounted axially fixedly in a drive unit housing 9 of the drive unit 5. The drive unit housing 9 may be a separate component that serves to receive solely the drive unit components 6, 7, 8 and is coupled axially fixedly and rotationally fixedly to a housing part 10*a*, 10*b* of the housing 10 of the spindle drive 1. Or, the drive unit housing 9 is formed by a housing part 10*a*, 10*b* of the housing 10 of the spindle drive 1 and to this extent may be formed integrally with the respective housing part 10*a*, 10*b*.

Located drivingly downstream of the drive unit 5 is a spindle-nut gear 11 with a geometric spindle axis A running in the axial direction X, for generating linear drive movements of a spindle-side drive connection 12*a* relative to a nut-side drive connection 12*b* of the spindle drive 1, between a retracted position and an extended position of the spindle drive 1. A drive movement in the direction of the retracted position corresponds to closing of the closing element 3, and a drive movement in the direction of the extended position corresponds to opening of the closing element 3.

The spindle-nut gear 11 of the spindle drive 1 may include a rotating spindle 11*a* and a nut 11*b* in meshing engagement therewith. The spindle-nut gear 11 may or may not be self-locking. The spindle 11*a* may be coupled axially fixedly to the drive unit 5 via a coupling arrangement 13 in the form of a claw coupling.

The drive unit 5 and the spindle-nut gear 11 are arranged in a drive train 14 of the spindle drive 1 which extends from the spindle-side drive connection 12*a* to the nut-side drive connection 12*b*. The spindle-side drive connection 12*a* may be connected, e.g., crimped, axially fixedly and/or rotationally fixedly to the drive unit housing 9 and/or the assigned housing part 10*a* of the housing 10 of the spindle drive 1.

The spindle 11*a*, which may be coupled axially fixedly via the drive unit 5 to the spindle-side drive connection 12*a*, is guided so as to be axially movable in a spindle guide tube 15. The spindle guide tube 15 may be connected axially fixedly and rotationally fixedly to the spindle nut 11*b*, and coupled also axially fixedly and rotationally fixedly with the nut-side drive connection 12*b*. Furthermore, a spring guide tube 16 is arranged radially around the spindle 11*a* and the spindle guide tube 15, and may be coupled rotationally fixedly and axially fixedly to the nut-side drive connection 12*b*. Since the spindle nut 11*b*, for example, is held rotationally fixedly via the drive connections 12*a*, 12*b*, a rotational movement of the spindle 11*a* is converted via the nut 11*b* into a translational movement of the spindle guide tube 15, which is coupled rotationally fixedly with the nut 11*b*. Accordingly, the two drive connections 12*a*, 12*b* may be moved relative to each other in the axial direction X, i.e., along the spindle axis A.

The spindle drive 1 may include a two-piece housing 10 having a drive tube 10*a* and an output tube 10*b* guided telescopically relative to each other. The drive tube 10*a* may be coupled to the spindle-side drive connection 12*a*, and the output tube 10*b* may be connected to the nut-side drive connection 12*b*, in each case axially fixedly and/or rotationally fixedly. In the exemplary embodiment shown in FIGS. 2 to 4, the output tube 10*b* forms an outer tube, wherein the drive tube 10*a* is guided telescopically therein as an inner tube. In the exemplary embodiment in FIG. 5 however, the drive tube 10*a* is an outer tube in which the output tube is guided telescopically as an inner tube.

Figure 2:
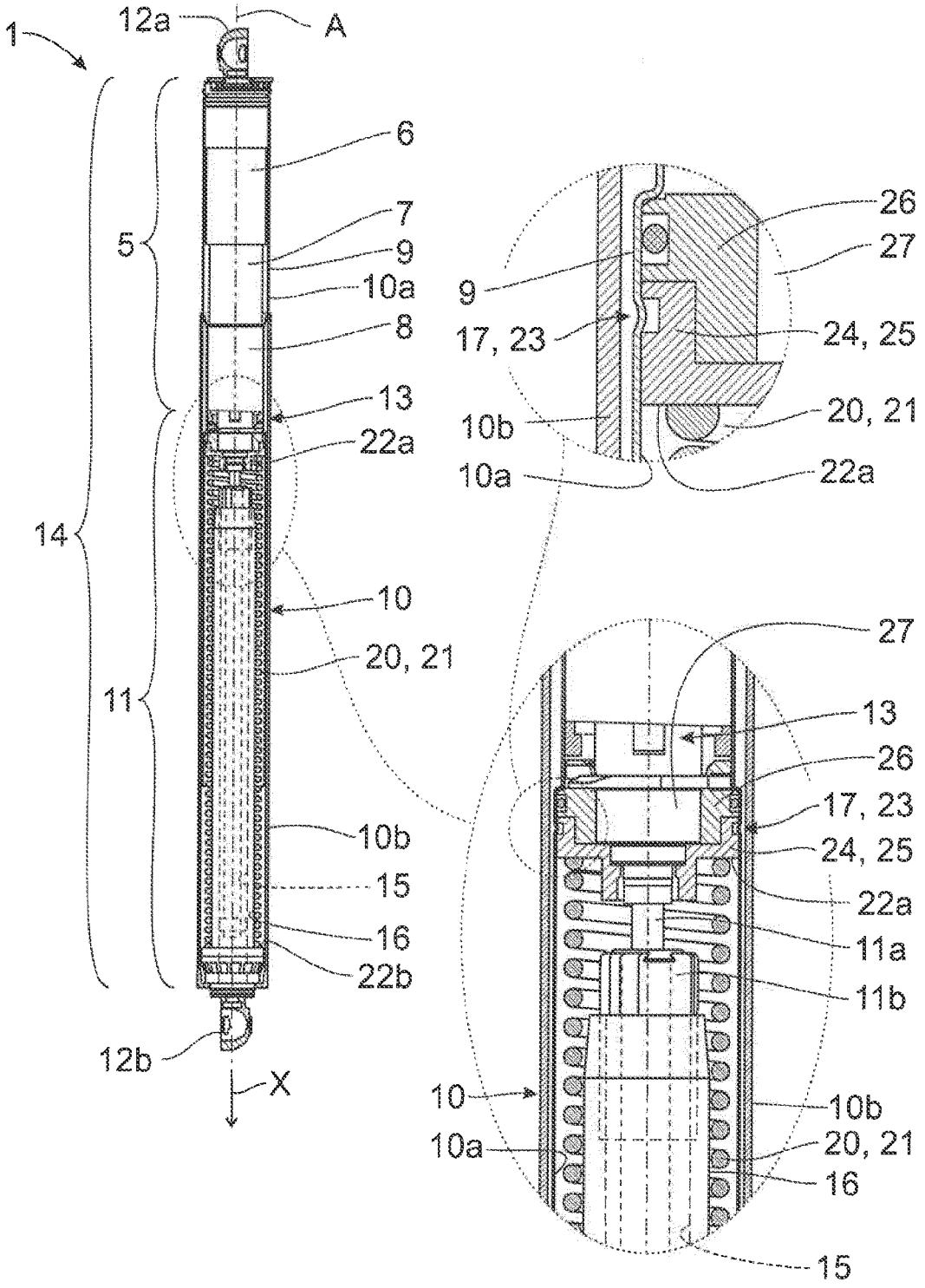
FIG. 2 is a detail view of an exemplary embodiment of the spindle drive from FIG. 1 in the correctly retracted state.
Figure 3:
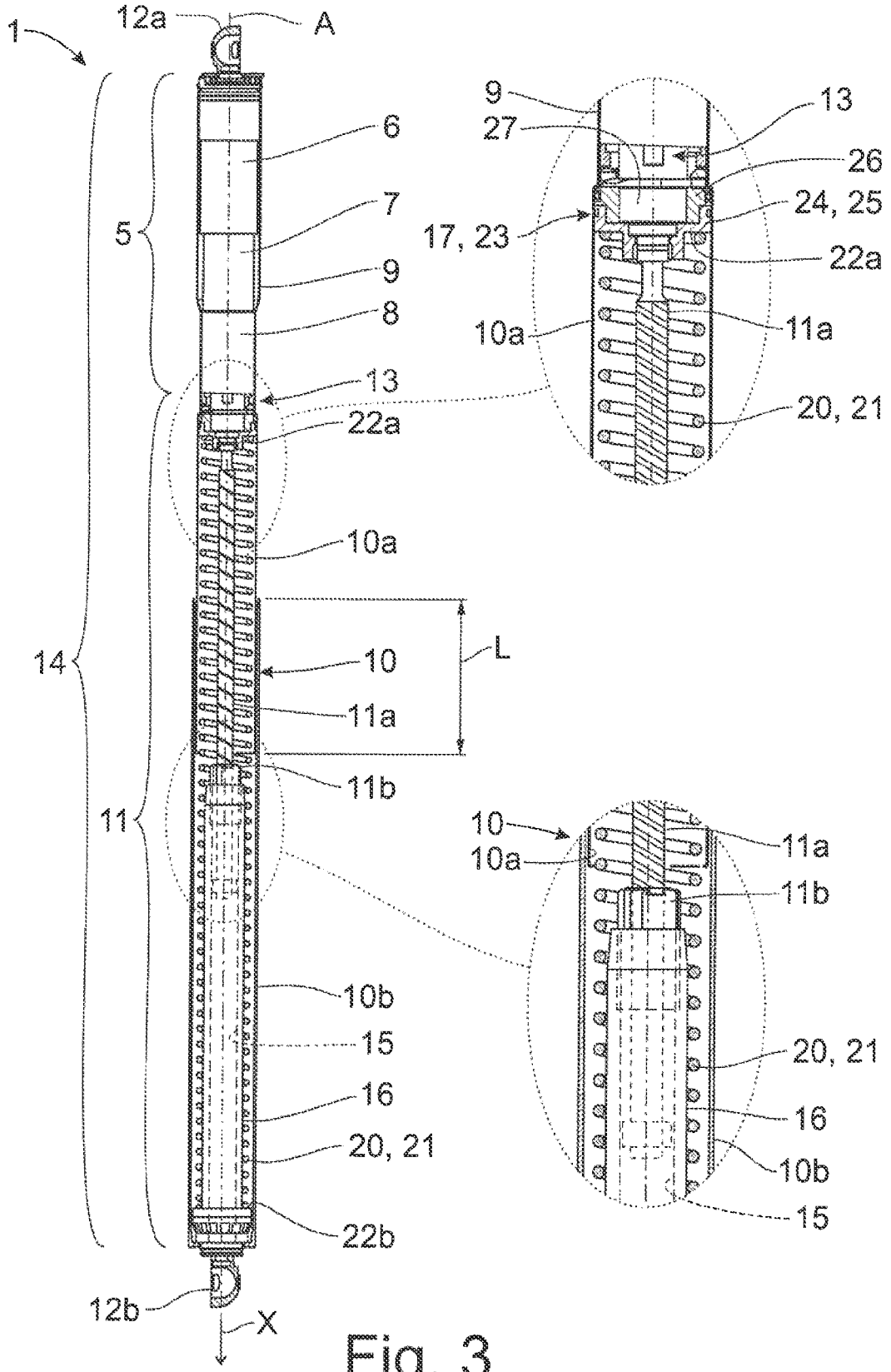
FIG. 3 is a detail view of the spindle drive from FIG. 2 in the correctly extended state.
Figure 4:
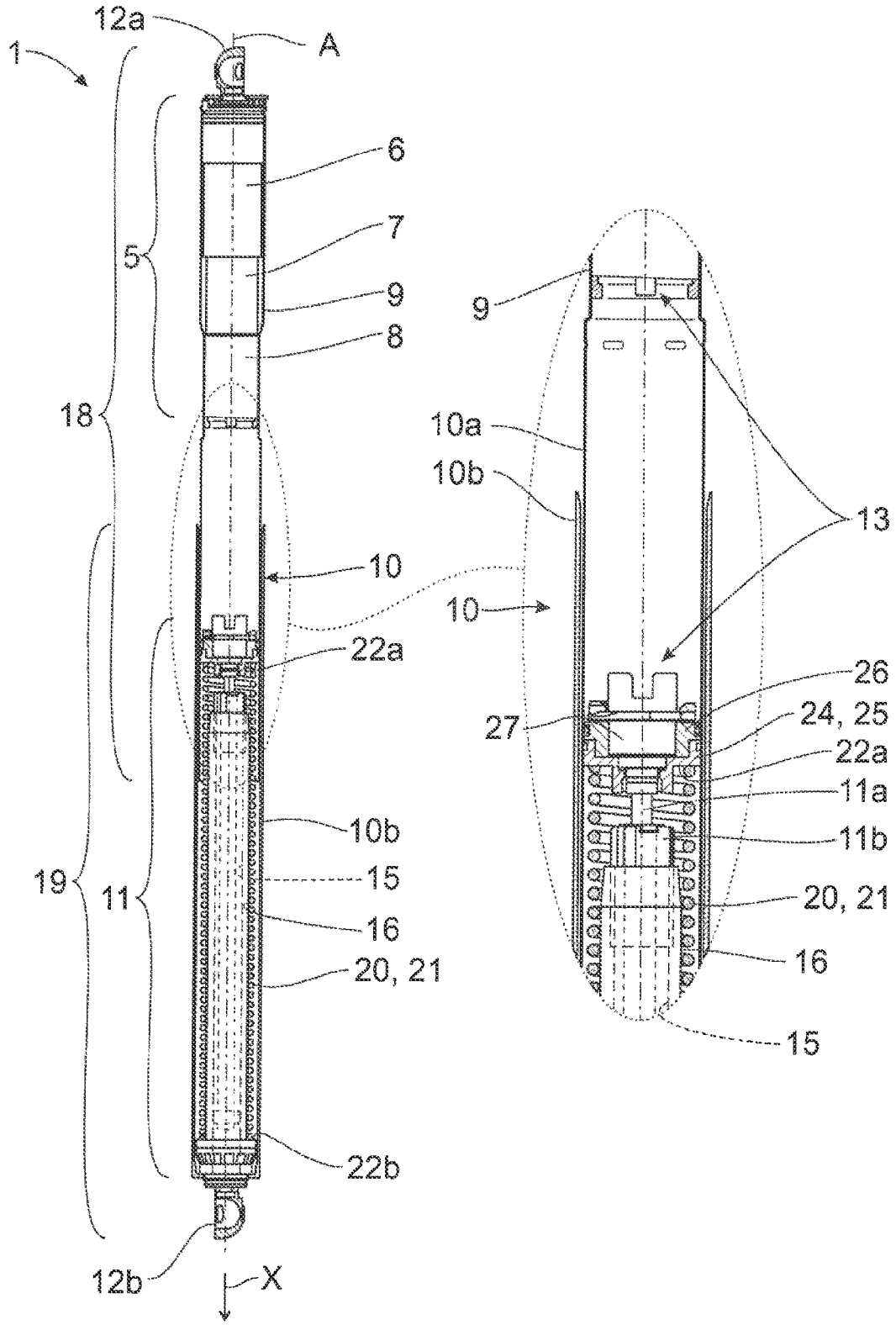
FIG. 4 is a detail view of the spindle drive from FIG. 2 after the occurrence of a load limit case.
Figure 5:
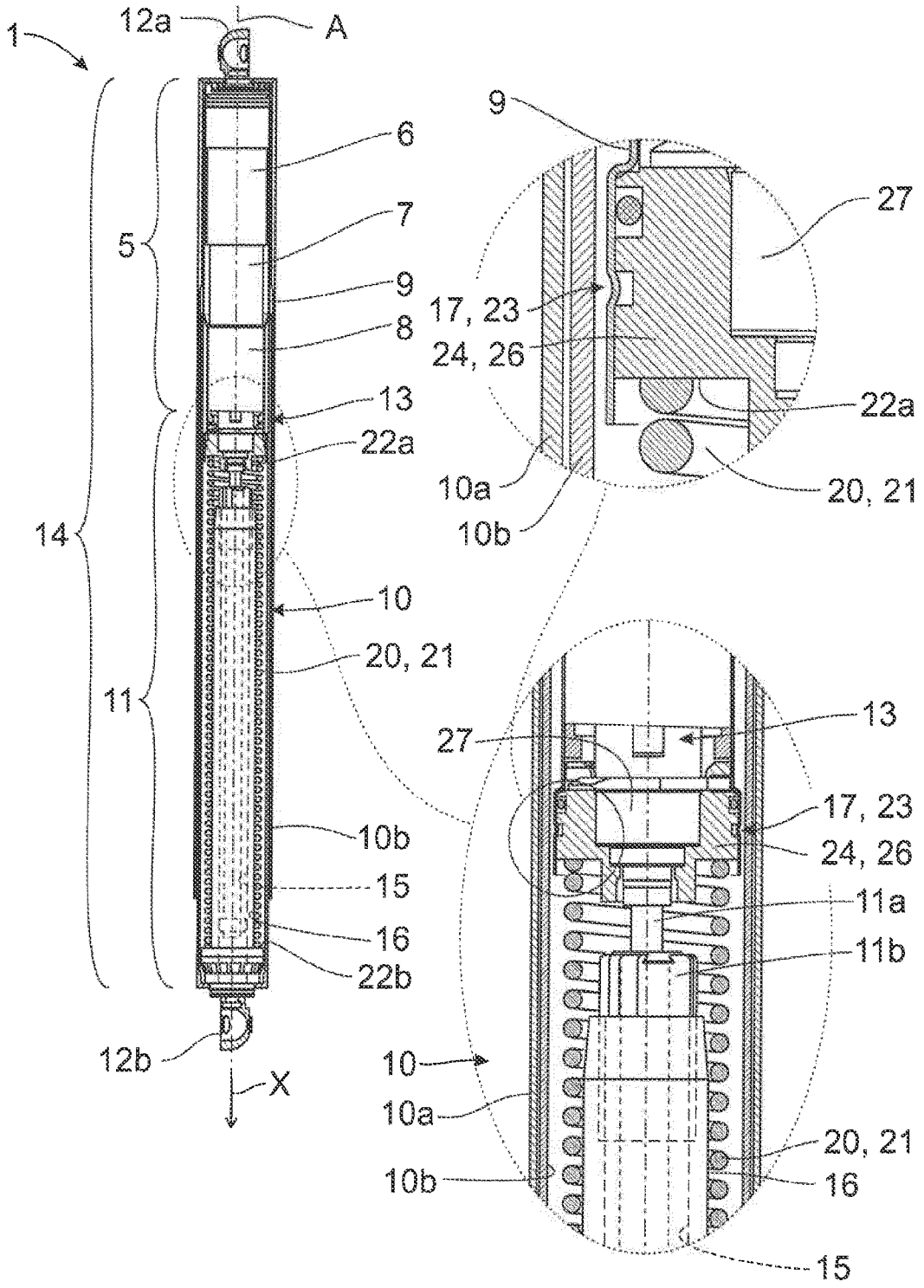
FIG. 5 is a detail view of a further exemplary embodiment of the spindle drive from FIG. 1 in the correctly retracted state.

The drive unit housing 9 (which may be formed by the drive tube 10*a* in the exemplary embodiment of FIGS. 2 to 4, and which in the exemplary embodiment of FIG. 5 constitutes a separate component that is coupled axially fixedly and/or rotationally fixedly to the drive tube 10*a*) may receive a drive motor 6, an intermediate gear 7 connected drivingly downstream thereof and coupled torque-transmissively therewith, and an additional component 8 that in turn is connected drivingly downstream of and coupled torque-transmissively to the latter. The additional component 8 may be an overload coupling capable of decoupling the drive train 14 and the drive unit 5 when a specific torque is exceeded. The additional component could also be a brake that brakes the drive train 14 inside the drive unit 5. The drive unit 5 may have only one or two of said components, or also more components.

In the spindle drive 1, the drive train 14 may include a nominal break point 17, i.e., a targeted weak point that separates the drive train 14 when a predefined axial load limit—also described below as a load limit case—acts on the spindle drive 1 via the drive connections 12*a*, 12*b*. An axial load limit means a load, such as a tensile load, acting in the axial direction. The load limit case occurs upon reaching a predefined tensile force acting in the direction of the extension position of the spindle drive 1. A load limit case may also be provoked under the additional effect of other forces and/or moments acting on the drive train 14. The axial load may be the predominate load during the load limit case.

The provision of such a nominal break point 17 has the advantage that, in a load limit case, for example, on a panic intervention by the user against the electric closing movement of the tailgate, or if the user manually presses the tailgate beyond the mechanical stop, the drive train 14 is indeed separated but the spindle drive remains at least largely undamaged.

The drive train 14 is separated in a load limit case via the nominal break point 17 between the drive unit 5 and the spindle-nut gear 11. The nominal break point 17 arranged such that the force flow, e.g., the torque transmission, is interrupted between the drive unit 5 and the spindle-nut gear 11 in the load limit case by the action of an axial load.

The provision of a nominal break point 17, such as the only nominal break point 17 in the drive train 14, between the drive unit 5 and the spindle-nut gear 11 (or between the drive unit 5 and the spindle 11*a*) has the advantage that the components causing the drive movements, e.g., the components 6, 7, 8 of the drive unit 5 on one side and the components 11*a*, 11*b* of the spindle-nut gear 11 on the other, remain in the housing 10 and do not come loose, in any case not directly on occurrence of the load limit case, and the spindle drive 1 is also not torn away from the motor vehicle 4, the closing element 3, or the vehicle body. In this way, even after occurrence of the load limit case, the spindle drive 1 still ensures a retaining function, at least to a certain degree, and also allows manual operation of the closing element 3, e.g., the tailgate, in any case in the direction of the closed position. A further advantage is that the robustness of the drive connections 12*a*, 12*b* is not reduced since these have no nominal break point, which, as explained, is particularly advantageous in the case of active/passive systems.

As already described above, the housing 10 of the spindle drive 1 may include a drive tube 10*a* and an output tube 10*b* that cooperate with one another telescopically. In this way, the drive tube 10*a* may be displaced axially relative to the output tube 10*b* to a certain extent. There is, therefore, an axial overlap of the two telescopically guided housing parts 10*a*, 10*b*, both in the retracted position and in the extended position of the spindle drive. The size of the axial overlap in the extended position of the spindle drive, also referred to below as the axial length L, is important for determining the axial deflection of the drive tube 10*a* relative to the output tube 10*b* of the spindle drive 1 at which, in the least favorable case—if the latter is in the extended position with the smallest overlap—it breaks into two parts that are no longer connected to each other. Until the axial length L is exceeded, the drive tube 10*a* and the output tube 10*b* overlap, whereby the spindle drive 1 is held together and still functions with restrictions. It is therefore preferable if said axial length L, over which the telescopically co-operating housing parts 10*a*, 10*b* are axially guided into one another, is as large as possible.

This is the case here, such that after separation of the drive train 14 at the nominal break point 17, a first component unit 18 is formed from components that are axially fixed relative to each other, and comprises as components at least the drive unit 5, the spindle-side drive connection 12*a* and the drive tube 10*a*; and a second component unit 19 is formed from components that are in particular axially fixed relative to each other, and comprises as components at least the spindle-nut gear 11, the nut-side drive connection 12*b* and the output tube 10*b*. When the drive train 14 separates at the nominal break point 17 in the load limit case, the first component unit 18 and the second component unit 19 are then movable relative to each other in the axial direction X, namely within the above-mentioned limits defined by the overlap. In one or more embodiments, the first component unit 18 is guided axially relative to the second component unit 19 via the telescopically co-operating housing parts 10*a*, 10*b* of the housing 10 over an axial length L of at least 40 mm, but, may be at least 60 mm, or at least 80 mm.

The spindle drive 1 may have a spring arrangement 20, which in normal operation preloads the spindle-side drive connection 12*a* and the nut-side drive connection 12*b*, and accordingly the spindle 11*a* and the nut 11*b*, against each other in the extended position of the spindle drive 1. The spring arrangement 20 for this has a spring element 21, which may be a compression spring, e.g., a coil compression spring. The spring element 21 here, in the load limit case when the drive train 14 is separated at the nominal break point 17, is part of the second component unit 19, which also comprises the spindle-nut gear 11, the nut-side drive connection 12*b*, and the output tube 10*b*. In the separated state of the drive train 14, the spring element 21 may be axially fixed relative to the other components of the second component unit 19. The term "axially fixed" with respect to the spring element 21 means that this may still expand in the direction of the preload if, after separation of the drive train 14, the spindle-nut gear 11 is not yet in its end position corresponding to the extended position, but the spring element 21 as a whole cannot come loose from the second component unit 19 and thus break free suddenly. The second component unit 19 may also include the spring bearings 22*a* and 22*b* on which the spring element 21 rests axially. The spring guide tube 16 is also part of the second component unit 19. The spring bearings 22*a*, 22*b* and/or the spring guide tube 16 may be arranged axially fixedly relative to the other components of the second component unit 19.

The nominal break point 17 provided on the spindle drive 1 according to the proposal here is formed by a connecting point 23, e.g., a radial connecting point 23, at which a first component and the second component of the spindle drive 1 are connected together by form fit and/or force fit and/or substance bonding, or in one embodiment, crimped together. On reaching the load limit causing separation of the drive train 14, i.e., in the load limit case, the connection is then broken at the connecting point 23 and the drive train 14 thereby separated. More specifically, in the load limit case, a form-fit and/or force-fit and/or substance-bonded connection, e.g., a crimp connection, is broken.

In order to ensure the separation of the drive train 14 at the nominal break point 17 as reproducibly as possible, the nominal break point 17 may be designed weaker by at least 5%, at least 10%, or at least 15% than all other components and connecting points of the drive train 14 of the spindle drive 1 which receive this load, e.g., the tensile load. This means that in the case of a load limit, for example under excessive tensile force, only the nominal break point 17 "breaks", i.e., the spindle drive 1 separates into two parts. In particular, the connection is released exclusively at said connecting point 23. Here, the axial load limit which, when reached, leads to separation of the drive train 14 at the nominal break point 17, is between 5,000 and 15,000 N, between 5,000 and 10,000 N, or between 6,000 and 9,000 N.

The first component of the connecting point 23 may be an annular or sleeve-like fixing element 24 that is configured to fix the spindle 11*a* axially relative to the drive unit 5 in the direction pointing away from the drive unit 5. The fixing element 24 may be a crimp ring 25, i.e., an annular element which can be crimped to another component. The crimp ring 25 here serves to fix a bearing sleeve 26 for receiving a spindle bearing 27, e.g., a ball bearing, axially in the direction pointing away from the drive unit 5. Such a fixing element 24 configured as a crimp ring 25 is provided in the exemplary embodiment according to FIGS. 2 to 4. In the exemplary embodiment according to FIG. 5, the fixing element 24 is formed by the bearing sleeve 26, which serves to receive the spindle bearing 27, e.g., the ball bearing. An additional crimp ring is not necessarily provided in the latter case.

The second component of the connecting point 23, which in normal operation is connected to the first component, e.g., the fixing element 24, may be one of the housing parts 10*a*, 10*b* of the housing 10, such as the tubular housing part forming the drive tube 10*a*, which is coupled axially fixedly to the drive unit 5 and the spindle-side drive connection 12*a*. The tubular housing part or drive tube 10*a* receives at least one drive unit component 6, 7, 8, e.g., the drive motor 6 and/or the intermediate gear 7 and/or the additional component 8, and serves for axial fixing of the respective drive unit components 6, 7, 8.

The first component, e.g., the fixing element 24, which forms a crimp ring 25 or a bearing sleeve 26, is arranged radially inside the second component, e.g., the drive tube 10*a*. The first component here bears on the second component radially on the inside at the connecting point 23 and is crimped thereto.

For the design of the drive connections 12*a*, 12*b*, numerous variants are conceivable. Here, the two drive connections 12*a*, 12*b* each provide a socket for a ball-socket coupling of the spindle drive 1 to a counter-piece, e.g., a ball, on the body or closing element. In principle, here the reverse case is also conceivable in which the respective drive connection 12*a*, 12*b* provides a ball that cooperates with a corresponding socket as a counter-piece provided on the body or closing element. Here, the drive connections 12*a*, 12*b* themselves have no nominal break point. The single nominal break point 17 of the spindle drive 1 is the nominal break point 17 described in detail above.

According to a further teaching, a closing element assembly 2 of a motor vehicle 4 may include a closing element 3 coupled movably to the body of the motor vehicle 4, and at least one spindle drive 1 of the type described above. Sometimes, two spindle drives 1 of the type described above are provided with one on each side of the closing element 3. In principle, it is also conceivable to provide the proposed spindle drive 1 as a single spindle drive, wherein the other side of the closing element 3 may be designed as the passive side, i.e., with a non-driven gas compression spring.

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

LIST OF REFERENCE NUMERALS

1 spindle drive
2 closing element assembly
3 closing element
4 motor vehicle
5 drive unit
6 drive motor
7 intermediate gear
8 additional component
9 drive unit housing
10 housing
10*a* drive tube
10*b* output tube
11*a* spindle
11*b* spindle nut
11 spindle-nut gear
12*a* spindle-side drive connection
12*b* nut side drive connection
13 coupling arrangement
14 drive train
15 spindle guide tube
16 spring guide tube

17 nominal break point
18 first component unit
19 second component unit
20 spring arrangement
21 spring element
22*a* spring bearing
22*b* spring bearing
23 connecting point
24 fixing element
25 crimp ring
26 bearing sleeve
27 spindle bearing While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A spindle drive for a closing element of a motor vehicle comprising:

a drive train of the spindle drive, including a drive unit and a spindle-nut gear located drivingly downstream of the drive unit, the spindle-nut gear having a spindle with a geometric spindle axis running in an axial direction of the spindle drive and a nut in meshing engagement with the spindle in order to generate linear drive movements of a spindle-side drive connection relative to a nut-side drive connection between a retracted position and an extended position of the spindle drive, wherein the drive train further includes a nominal break point that mechanically separates the drive train in response to a predetermined axial load limit acting on the spindle drive via the drive connections; wherein the drive train is mechanically separated via the nominal break point between the drive unit and the spindle-nut gear.

2. The spindle drive of claim 1 further comprising a housing with a drive tube coupled axially fixedly to the spindle-side drive connection, and an output tube coupled axially fixedly to the nut-side drive connection, wherein the drive tube and the output tube are configured for telescopic movement relative to each other.

3. The spindle drive of claim 2, wherein by mechanically separating the drive train at the nominal break point, a first component unit is formed which comprises the drive unit, the spindle-side drive connection and the drive tube, and a second component unit is formed which comprises the spindle-nut gear, the nut-side drive connection and the output tube, wherein said component units are movable relative to each other in the axial direction.

4. The spindle drive of claim 3, wherein the spindle drive has a spring arrangement that preloads the spindle-side drive connection and the nut-side drive connection against each other in the extended position of the spindle drive.

5. The spindle drive of claim 1, wherein the nominal break point is designed weaker with respect to tensile loading, by at least 5 percent than all other components of the drive train of the spindle drive.

6. The spindle drive of claim 1, wherein the nominal break point is formed by an in particular a radial connecting point at which a first component and a second component of the spindle drive are connected together by form fit or substance bonding, wherein the connecting point is broken on reaching the axial load limit causing the mechanical separation of the drive train.

7. The spindle drive of claim 6, wherein the first component is an annular fixing element that is configured to fix the spindle axially relative to the drive unit in a direction pointing away from the drive unit.

8. The spindle drive of claim 7, wherein the second component is a tubular housing part that is coupled axially fixedly to the drive unit, wherein the tubular housing part receives and axially fixes a drive motor or an intermediate gear of the drive unit.

9. The spindle drive of claim 8, wherein the tubular housing part is coupled axially fixedly and rotationally fixedly to an outer tube of a housing of the spindle drive.

10. The spindle drive of claim 6, wherein the first component is arranged radially inside the second component and bears radially on an inside of the second component at the connecting point.

11. The spindle drive of claim 1, wherein each of the drive connections is configured to couple to a motor vehicle via a ball-socket coupling.

12. The spindle drive of claim 3, wherein the first component unit is guided axially relative to the second component unit via the telescopic movement of the drive tube and the output tube such that, in the extended position of the spindle drive, the first component unit is guided axially relative to the second component unit over an axial length (L) of at least 40 millimeters.

13. The spindle drive of claim 4, wherein the spring arrangement has a compression spring that is part of the second component unit.

14. The spindle drive of claim 7, wherein the annular fixing element is a crimp ring that fixes a bearing sleeve for receiving a spindle bearing axially in the direction pointing away from the drive unit.

15. A closing element assembly of a motor vehicle comprising:

a closing element; and a spindle drive including:

a drive train having a drive unit and a spindle-nut gear, the spindle-nut gear having a spindle with a geometric spindle axis running in an axial direction of the spindle drive and a nut in meshing engagement with the spindle in order to generate linear drive movements of a spindle-side drive connection relative to a nut-side drive connection between a retracted position and an extended position of the spindle drive, wherein the drive train further includes a nominal break point that mechanically separates the drive train in response to a predetermined axial load limit acting on the spindle drive via the drive connections, wherein the drive train is mechanically separated via the nominal break point between the drive unit and the spindle-nut gear.

16. A spindle drive for a closing element of a motor vehicle comprising:

a drive tube connectable to one of a closing element and a motor vehicle;

an output tube connectable to the other of the closing element and the motor vehicle, wherein the drive tube and the output tube are telescopically connected to each other; and a drive unit including:

an actuator fixed to the drive tube, a spindle at least partially disposed in the drive tube and the output tube, the spindle being retained to the actuator, for rotation therewith, by a fixing member that is attached to the drive tube by a connecting point, wherein the connecting point is configured to release the fixing member from the drive tube to decouple the spindle and the actuator when an axial load on the spindle drive exceeds an axial load limit, and a spindle nut meshing with the spindle and operably coupled to the output tube, the spindle nut being configured to generate linear drive movements of the output tube relative to the drive tube between retracted and extended positions when the spindle is rotated by the actuator.

17. The spindle drive of claim 16, wherein the fixing member is a crimp ring attached to the drive tube by the connecting point with a force-fit.

18. The spindle drive of claim 16 further comprising a spring arrangement connected between the output tube and the fixing member to bias the drive tube away from the output tube.

19. The spindle drive of claim 16, wherein the drive unit further includes a spindle bearing retained on the spindle by the fixing member.

* * * * *